US005677682A

United States Patent [19]

Thorsen et al.

[11] Patent Number: 5,677,682

[45] Date of Patent: Oct. 14, 1997

[54] ELECTRONIC LOCK SYSTEM

[76] Inventors: Anders Christian Thorsen, 9 Høvej, DK-9982 Ålbæk, Denmark; Jan Stefan Thorsen, 4 Gråklit, DK-9990 Skagen, Denmark; Arne Kristian Poulsen, 183 Skarpæsvej, DK-9990 Skagen, Denmark

[21] Appl. No.: 379,585

[22] PCT Filed: Aug. 5, 1992

[86] PCT No.: PCT/DK93/00253

§ 371 Date: Feb. 6, 1995

§ 102(e) Date: Feb. 6, 1995

[87] PCT Pub. No.: WO94/03690

PCT Pub. Date: Feb. 17, 1994

[30] Foreign Application Priority Data

Aug. 5, 1992 [DK] Denmark ..... 92 00069
Mar. 2, 1993 [DK] Denmark ..... 0234/93

[51] Int. Cl.[6] ..... E05B 47/00

[52] U.S. Cl. ..... 340/825.31; 70/278

[58] Field of Search ..... 340/825.31; 235/382, 235/382.5; 361/172; 70/278, 277

[56] References Cited

U.S. PATENT DOCUMENTS

| | | | |
|---|---|---|---|
| 4,079,605 | 3/1978 | Bartels . | |
| 4,144,523 | 3/1979 | Kaplit | 340/825.31 |
| 4,288,780 | 9/1981 | Theodoru et al. | 340/825.31 |
| 4,734,693 | 3/1988 | Dluhosch et al. . | |
| 4,791,280 | 12/1988 | O'Connel et al. | 340/825.31 |
| 4,868,559 | 9/1989 | Pinnow . | |
| 5,006,843 | 4/1991 | Hauer . | |

FOREIGN PATENT DOCUMENTS

| | | |
|---|---|---|
| 0424356A1 | 4/1991 | European Pat. Off. . |
| 0424356B1 | 4/1991 | European Pat. Off. . |
| 2258854 | 12/1972 | Germany . |
| 2431497C2 | 1/1975 | Germany . |
| 3103028 | 8/1982 | Germany . |

*Primary Examiner*—Edwin C. Holloway, III
*Attorney, Agent, or Firm*—Sughrue, Mion, Zinn, Macpeak & Seas, PLLC

[57] ABSTRACT

A lock system comprising an electromechanical lock and code generator, and an electronic code lock, which is connected to a code transportation medium. The electronic lock and code generator is a system, where the code medium includes both a mechanical and an electrical code, which both must be present with the correct code before the code transport transmitter can be activated. The transmission of the code takes place within a short time interval and at an individual transmission rate, and a timed blocking is built-in in case of an incorrect optical code, and a circuit counteracting voltage manipulation is built-in. The code transportation medium is electrical or optical. The electronic code lock is a system, where the correct code must be received twice successively. A built-in timed blocking of the analysis of the code is activated if an incorrect code is received, or if the code has not been received at the correct transmission rate, and an electronic circuit counteracting voltage manipulation is built-in.

25 Claims, 6 Drawing Sheets

ELECTRONIC LOCK SYSTEM

FIELD OF THE INVENTION

The invention relates to a lock system of the type comprising a lock shell, a lock core, a key for insertion into the lock core, a number of locking pins installed in the lock shell and the lock core, and where the key shaft has a given mechanical key profile corresponding to the configuration of the locking pins and specific to the lock in question, which lock system furthermore preferably includes an electro-optical arrangement for reading a code, where the said code is specific to the lock in question and its corresponding key.

BACKGROUND OF THE INVENTION

Lock systems of the type mentioned above are for instance known from U.S. Pat. No. 4,868,559. These lock systems are primarily intended for use in connection with the theft proofing of motor vehicles, but may in addition be utilized for instance for the protection of rooms and offices, to which unauthorized persons are not to be admitted, safe deposit boxes, and the like.

With reference to the mentioned document, a flat key in combination with a light emitting diode and a photo diode for an analogue reading of the coded profile of the edge of the key are utilized. The light intensity received by the photo diode is in direct relation to the depth of the cuts in the key shaft, and the thus established analogue electrical signal reproduces the edge profile of the key shaft, when the key is inserted into the lock core. The electrical signal is then by wire sent from the lock shell to a circuit, which analyzes the signal, compares it to one or several reference signals in a memory bank, and determines whether the lock can be accepted as valid.

A drawback of this technique is that an analogue reading is employed, where this reading may be encumbered by errors caused for instance by wear, dirt, electrical noise, etc. In addition, there is only a relatively limited number of possible combinations of peaks and troughs in the key profile, which among other things is due to the fact that the key profile is read by one light emitting diode/photo diode unit, while the key is in motion.

SUMMARY OF THE INVENTION

The invention aims to remedy such drawbacks, and provides a lock system which gives a high degree of protection.

In order to achieve this, a lock system according to the invention of the type mentioned above is characterized

- in that the key is of the type comprising a key shaft with a key profile in the longitudinal direction of the key shaft,
- in that the key shaft is designed with a number of holes, which, with respect to the longitudinal axis of the key shaft coinciding with the longitudinal axis of the lock core, extend substantially perpendicular to the direction of the longitudinal axis of the key shaft,
- in that there in the lock shell, at one and the other side thereof, respectively, with respect to the lock core, is placed at least one light transmitter and one light receiver.
- in that the lock core is designed with at least two light signal transmitting channels, one end of the said channels opening out into the longitudinal centre line of the key shaft, and
- in that there in the lock shell, at one and the other side thereof, respectively, with respect to the lock core, is placed two light signal transmitting channels, which are positioned in such a manner as to transmit a light signal from the light transmitter to the light receiver for at least one given angular position of the lock core, where the core is turned by the key.

The invention relies on the realization that the combination of a reading of a key profile of a stationary key with the actual mechanical actuation (turning) of the lock core, by which the light signal for reading the code of the key is transmitted through the lock cylinder, provides the opportunity for an on-site determination of whether the key fits the lock and, whether it possesses the correct code.

Further suitable embodiments of the lock system according to the invention are apparent in the dependent claims.

The electromechanical lock system according to the invention is divided into three units:

An electromechanical lock and code generator

A code transportation medium

An electronic code lock

At the actuating site a unit is present, i.e. the electromechanical lock and the code generator, and from this site the user may actuate and release the lock system by means of an external, code medium, i.e. a coded key.

The transportation medium serves the purpose of transporting the code from the electromechanical lock and code generator placed at the actuating site to the electronic code lock placed at the locking site.

A unit, i.e. the electronic code lock, is present at the locking site or sites, such that the said electronic code lock receives the code at the locking site and analyzes this in order to determine its validity. The electronic code lock must be unbreakably built together with the electrical or mechanical parts adapted for the locking task. As regarding the electronic code lock, see our utility model registration No. 9200069.

The technique according to other patents, U.S. Pat. No. 3,619,633, U.S. Pat. No. 4,682,062, U.S. Pat. No. 4,751,396 and GB patent 2175646 A., suffers from a weakness, namely that a code generator in which the code at any time may be keyed or turned in is utilized, which in turn results in the fact that the code may be read (seen) while the technique is activated, or may be read when the keyboard is activated; that the code may be read while it is keyed in. It is only in the text of U.S. Pat. No. 4,682,062 stated that this patent also may be provided with a device accommodating a key. However, all the mentioned patents utilize parallel code transmission, which firstly makes the installation difficult, and secondly makes it possible to open the transmission path, thus allowing for entry with an automatic code generator, by which the code may be found after a relatively short period of time with a subsequent release of the lock mechanism. Among other known techniques are remotely operated releases, known from central locking systems, operating with a modulated carrier frequency or some type of light as the transmission medium. These all have the very great drawback that it is possible with suitable equipment, from a distance, to read both the transmission type and the code. In the known versions it is not clear what effect a possible manipulation of the voltage will have on the circuits.

In this invention an electromechanical lock system of the type mentioned above is provided, where:

A system is provided in the electromechanical lock and code generator, where the code medium includes both a mechanical and an optical code, and where the optical code reading of the code medium only can commence if the mechanical code of the code medium is correct. The transmission of the code can only begin if the optical code of the code medium during reading and analysis shows correctness in two successive analyses are. The transmission of the code is carried out within predetermined short time intervals only, and at a predetermined transmission rate. A predetermined timed blocking is provided if the optical code is incorrect. A circuit counteracting voltage manipulations is built-in.

For the code transportation medium, an opening of the code transportation medium will not allow for an automatic search for the code, since the transmission rate is unknown and not possible to measure.

In the electronic code lock a system is provided, resulting in that the correct code must be received twice successively, and in that a built-in timed blocking is activated if an incorrect code is received or if the code is received at an incorrect transmission rate. Furthermore, a blocking is provided, where the said blocking only allows for reception of the code within a predetermined short time interval after startup, in addition to there being installed a circuit counteracting Voltage manipulation.

This is according to the invention achieved by an electromechanical lock system of the type mentioned above, where:

In the electromechanical lock and code generator, besides having designed this as a traditional cylindrical lock core with locking pins actuated by the coded edge of the code medium, one has, when the lock core is turned, the opportunity for reading the second code of the code medium, where the said second code is an optical code. This code is analyzed twice successively by the code generator in order to determine its correctness, and in order to subsequently obtain permission to begin a time limited transmission of the code with an individually predetermined transmission rate, or in the contrary case, to activate a timed blocking before an attempt using another code medium can take place. In addition, a circuit counteracting voltage manipulation is built into the electromechanical lock and code generator.

In the code transportation medium safety against breakage is achieved by only sending serial codes, and by only performing the transmission of the code within a very short time interval, and only if the correct optical code medium is present in the electromechanical lock and code generator, which results in the fact that the transmission rate only can be measured if one already possesses the correct code medium.

In the electronic code lock safety is achieved in that the said electronic code lock only accepts serial electrical or serial optical signals at a transmission rate, which is very accurately adapted for the lock in question, in that a blocking is provided, where the said blocking only permits reception of codes within a predetermined short time interval after startup. The code must be received correctly twice successively, in order to avoid the activation of a built-in timed blocking circuit. In addition, a circuit counteracting voltage manipulation is built into the electronic code lock.

When the code medium is inserted into the lock core, the locking pins will be raised by the mechanically coded edge of the code medium in such a manner as to release the lock core, such that it may be turned. When the lock core is turned a number of degrees away from the initial position, the light transmitting channels built into the lock shell are opened, the said light transmitting channels thus allowing for transillumination and a reading of the optical code of the code medium. This code is then, in the electronics, compared to a permanently stored code in order to determine its correctness, and will, in the case of conformity between these, cause the transmission of the code to begin within a predetermined short time interval and at a transmission rate, which is individually adapted for the lock in question. If the optical code is incorrect, a timed blocking of the reading of the optical code is activated. A security circuit counteracting voltage manipulation is in addition built into the electromechanical lock and code generator, where the said security circuit protects the electronics against damage and failure, while it in extreme instances will disconnect the power supply line.

When the electronic code lock receives the serial code from the code transportation medium, the said serial code will, following amplification, be converted to a parallel signal. This signal, which contains the received code, is now compared—presupposing that the transmission rate is correct—to a permanently stored code, and will in the case of conformity between the two codes send a signal to an RS Flip-Flop circuit. This circuit will now activate an optical driver, which in turn activates the power output and thus releases the lock mechanism built together with this circuit. In the case of nonconformity between the received code and the permanently stored code, a timed blocking of the electronics performing the analysis is carried out. In the electronic code lock there is also provided a circuit, which only opens up for the reception of the code within a predetermined short time interval after startup. In addition, a reset circuit is built into the electronic code lock, the said circuit ensuring that the circuit for comparison of the codes always will begin with the code analysis circuit being 'ready for code reception'. A security circuit is furthermore built into the code lock, where the said security circuit counteracts voltage manipulation, thus protecting the electronics against damage and failure, while it in extreme instances will disconnect the power supply line.

A particular thing, which forms a basis for the high degree of security obtained by this lock system, is that the mechanical part of the electromechanical lock and code generator is designed with two functions, where the first function is a conventional lock core with a coded edge release, and where this function must be performed before the second function can begin. The second function comprises a reading of the optical code, and requires that the lock core is turned a number of degrees, thereby opening the optical channels required for illumination and reading of the code medium.

A second particular thing, which forms a basis for the high degree of security obtained with this lock system, is that the code transmitter in the electromechanical lock and code generator only can be activated if both codes contained by the code medium are correct.

A third particular thing, which forms a basis for the high degree of security obtained with this lock system, is that the optical code of the code medium inserted into the electromechanical lock and code generator is analyzed twice successively in order to determine its correctness. This avoids that the possible occurrence of a noise pulse may cause an erroneous reading.

A fourth particular thing, which forms a basis for the high degree of security obtained with this lock system, is that the code transmitter built into the electromechanical lock and code generator transmits at a transmission rate, which is individually adapted for the lock in question.

A fifth particular thing, which forms a basis for the high degree of security obtained with this system, is that the code transmitter built into the electromechanical lock and code generator only is activated in order to transmit the code within a predetermined short time interval, in order to thereby avoid a measurement of the transmission rate.

A sixth particular thing, which forms a basis for the high degree of security obtained with this system, is that if the electronics built into the electromechanical lock and code generator receives incorrect codes from the code medium, then a timed blocking of the circuit in which the code analysis takes place is activated, where the said blocking takes place in such a manner that a systematic breaking of the code within a relatively short period of time is impossible.

A seventh particular thing, which forms a basis for the high degree of security obtained with this system, is that an optocoupling circuit is provided in the electromechanical lock and code generator with electrical output to the code transportation medium, where the said optocoupling circuit provides a galvanic separation of the electronics in the code generator from the code transportation medium. This results in the fact that the built-in electronics cannot be affected through the code output.

An eighth particular thing, which forms a basis for the high degree of security obtained with this system, is that a protection circuit is inserted in the power supply line in the electromechanical lock and code generator, where the said protection circuit, when the supply voltage rises above or falls below specified limiting values, protects in such a manner as to not only protect against damage, but also against failure, and in extreme instances will react by disconnecting the power supply line.

A ninth particular thing, which forms a basis for the high degree of security obtained with this system, is that the code analysis circuit built into the electronic code lock must receive the code at a transmission rate, which is individually adapted to the lock in question.

A tenth particular thing, which forms a basis for the high degree of security obtained with this system, is that a blocking of the code input is built into the electronic code lock, resulting in the fact that the input only is open within a predetermined short time interval after startup.

An eleventh particular thing, which forms a basis for the high degree of security obtained with this system, is that when the input to the electronic code lock is designed for reception of electrical signals from the code transportation medium, an optocoupling circuit is inserted in order to galvanically separate the electronics built into the electronic code lock from the code transportation medium. As a result, the built-in electronics cannot be affected through the code input.

A twelfth particular thing, which forms a basis for the high degree of security obtained with this system, is that the electronic code lock must receive and analyze two successively received codes for correctness before a validation. This avoids that the possible occurrence of a noise pulse may cause an erroneous reading.

A thirteenth particular thing, which forms a basis for the high degree of security obtained with this system, is that the electronic code lock must receive and analyze two successively received codes, and that if just one of these proves to be incorrect, a timed blocking of the circuit in which the analysis is performed will be carried out. As a result, a systematic breaking of the code within a relatively short period of time is impossible.

An fourteenth particular thing, which forms a basis for the high degree of security obtained with this system, is that a protection circuit is inserted in the power supply line in the electronic code lock, where the said protection circuit, when the supply voltage rises above or falls below specified limiting values, protects in such a manner as to not only protect against damage, but also against failure, while it in extreme instances will react by disconnecting the power supply line.

BRIEF DESCRIPTION OF THE DRAWINGS

The invention will in the following be described in more detail with reference to the drawing, where.

DETAILED DESCRIPTION OF THE PREFERRED EMBODIMENTS

Figure 1:
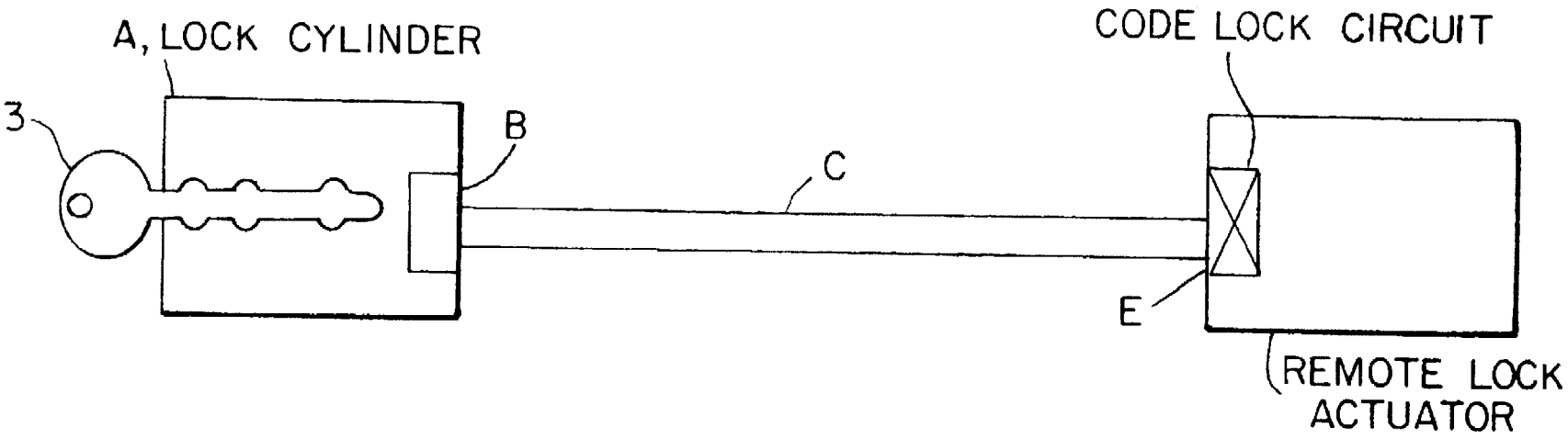
FIG. 1 shows an overall view of the electromechanical code lock and code generator, the code transportation medium, and the electronic code lock.

Item 1 shows the lock shell itself with bores for the lock core, item 2, the locking pins, item 4, and the light channels, item 10 and item 10*a*. In addition, two grooves for the lock rings, item 15, are turned at both ends of the hole bored for the lock core. Into the two sides of the lock shell, item 1, two recesses are milled out in order to accommodate the printed electronic circuit boards, item 7 and item 8, belonging to the system. Item 2 shows the lock core, wherein there is milled out a slot for the code medium, item 3, holes for locking pins, item 4, milled out light channels 9 and 9*a*, and turned grooves for the lock rings, item 15. In addition, an opportunity for making an optional external extension, item 6 (shown by the dashed line), is provided in the lock shell at the end opposite to the lock medium.

Item 3 shows the code medium with varying milled out grooves in the lengthwise direction, these being adapted to the particular lock, and with a coded edge for actuating the locking pins, item 4, and with traversing holes, item 11, for optical reading.

Figure 5:
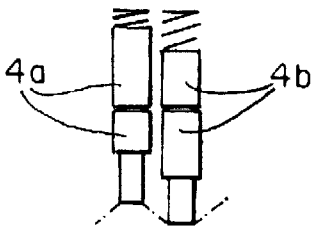
FIG. 5 shows a 1.5 times enlarged view of the locking pins utilized in the electromechanical lock and code generator.

Item 4 shows the locking pins, where these are installed in the lock shell. In addition, FIG. 5 shows the two types of locking pins, one of which is shown in item 4*a*, where the lower section is short and the upper section long, while the other is shown in item 4*b*, where the lower section is long and the upper section short.

The general function of the mechanical part of the electromechanical lock and code generator is such that when the code medium, item 3, is inserted fully into the lock core, item 2, the coded edge, item 14, of the said medium will raise the locking pins, item 4, in such a manner—presupposing that the code medium is correct that—the planes dividing the locking pins between an upper and a lower section will be aligned within the transition zone between the lock core, item 2, and the lock shell, item 1, thus releasing the lock core, item 2, which subsequently may be turned. When the lock core, item 2, is turned a number of degrees clockwise, there will be opened for the transmission of light from the light transmitters, item 12, through the light channels, item 10, of the lock shell, and into the light channels, item 9, of the lock core, after which the light at the centre of the lock core will strike the code medium, item 3. The code medium, item 3, will by way of its optical code (holes), item 11, allow the light in some of the light channels to pass into the light channels, item 9*a*, of the lock core, item 2, and then continue through to the opposite light channels, item 10*a*, of the lock shell, in order to be picked up here by the photocells, item 13, of the electronics. In the instance that no code medium is present in the lock core, item 2, the locking pins, item 4, will be pressed down towards their contact faces in the lock core, item 2, and their dividing planes will be positioned at a certain distance downwards into the lock core, item 2, and as a consequence the upper section of the locking pins, item 4, will be placed in the transition zone between the lock core, item 2, and the lock shell, item 1, thus preventing the lock core, item 2, from being turned.

In the instance of an incorrect code medium, item 3, it will not be possible to align all of the dividing planes of the locking pins in the transition zone between the lock core, item 2, and the lock shell, item 1, and a turning of the lock core, item 2, will thus be impossible.

Figure 6:
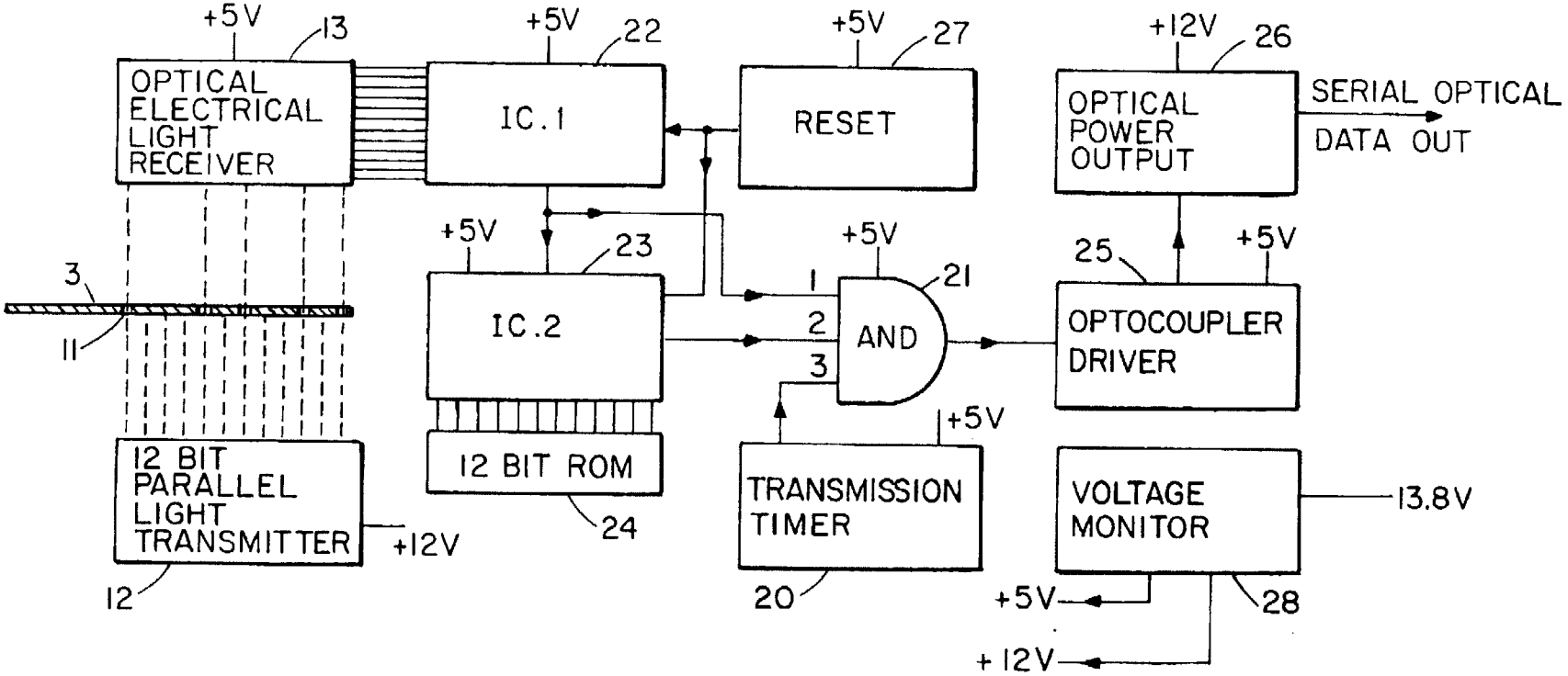
FIG. 6 shows the block diagram of the electronics with the serial optical output utilized in the electromechanical lock and code generator.

FIG. 6 shows a block diagram of the electrical circuit B for the electromechanical lock and code generator, with a serial optical output. In addition, please refer to the items in FIGS. 2, 3, and 4.

Figure 3:
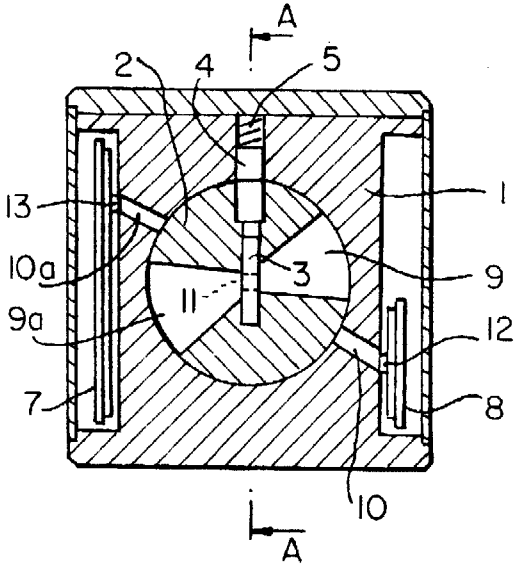
FIG. 3 shows a sectional view along the line B—B in the electromechanical lock and code generator.
Figure 4:
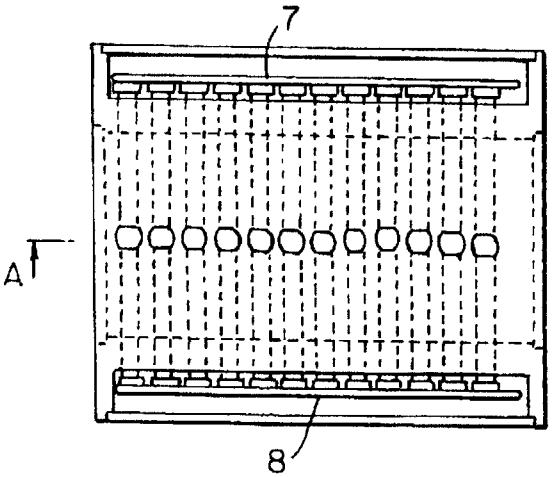
FIG. 4 shows a sectional view along the line B—B in the electromechanical lock and code generator.

At the instant when the code medium, item 3, is inserted into the lock core, item 2, in FIGS. 3 and 4, and the said core 2 is turned clockwise away from the locked position, the supply voltage is connected to the electronics built into the electromechanical lock and code generator B, and the following cycle of operations is carried out:

When the lock core 2 is turned, and current is supplied to the electronic circuit B, the timer circuit 20 is activated, and an activation signal is sent to the input 3 of the AND circuit 21 this activation signal only being present until the timing cycle of the timing circuit 20 has been run through, after which the AND circuit 21 again will be blocked, until the current supply has been disconnected.

Figure 2:
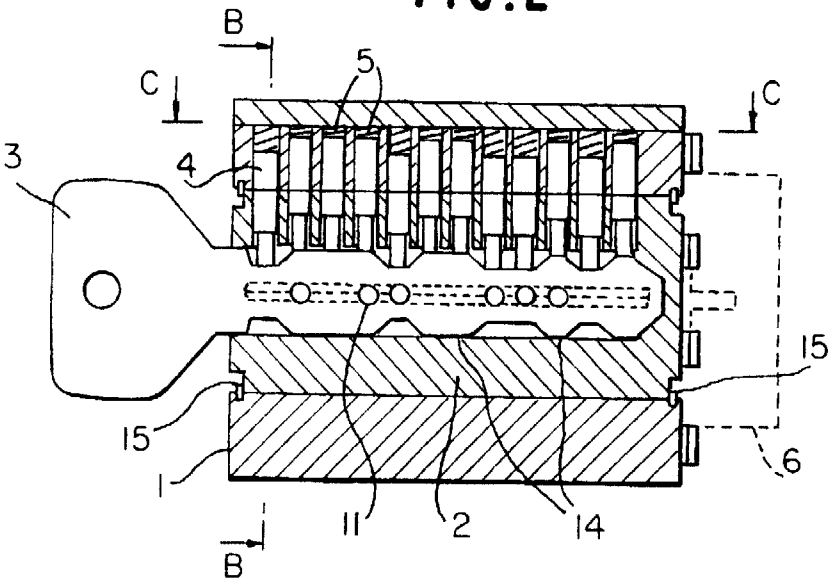
FIG. 2 shows a sectional view along the line A—A in the electromechanical lock and code generator.

The twelve light transmitters shown here, item 12, will transmit light through the light channel 10 of the lock shell 1 in FIG. 3, to and through the light channel 9 of the lock core 2 in FIG. 3 (assuming that the lock core, item 2 in FIGS. 2 and 3, is turned to its proper position, i.e. that it is turned a number of degrees in the clockwise direction), and further towards the light apertures, item 11, of the code medium 3.

If the code medium, item 3 in FIGS. 2 and 3, presents a light aperture, item 11, the light will continue through the light apertures, item 11, of the code medium 3, through the opposite light aperture channel, item 9*a* in FIG. 3, of the lock core 2, then through the opposite light channel, item 10*a* in FIG. 3, of the lock shell 1, in order to finally be received by the photocells, item 13, of the receiver (the photocells may be photo diodes or photo transistors). In the electrical circuit, the light received by the photocells 13 will be converted from optical signals to electrical signals, which now contain an electrical code based on the combination of holes, item 11, in the code medium 3. The code thus produced will then be passed to the parallel inputs of the integrated circuit (IC.1) 22. In IC.1 22, the signal is converted to a serial electrical signal. This signal is then sent to two locations: firstly, to the input 1 of a three-input integrated AND circuit 21, and secondly to the serial input of another integrated circuit IC.2 23. In the latter circuit, the two codes, which have been received successively at the serial input, will be compared to the code sent from the ROM circuit 24, to the parallel inputs of IC.2 23, and if there is conformity between these, an activation signal is sent from the output of IC.2 23, to the input 2 of the AND circuit 21. The AND circuit 21 is thus opened, assuming that the activation signal from the timer circuit 20 to input 3 of the AND circuit 21 still is present, and thus the serial signal on input 1 is allowed to pass through the AND circuit 21 in order to arrive at an optocoupled driver circuit 25 continuing through to the power output 26 of the code transmitter, where the said power output also functions as an electrical/optical converter, which then sends out the code on an optical code transportation medium at a predetermined transmission rate, and within a short time interval, which is predetermined by the timer circuit 20.

In the case of nonconformity between the received code at the serial input of IC.2 23, and the code delivered from the ROM circuit 24 to the parallel inputs of IC.2 23 no activation signal will be sent to input 2 of the AND circuit 21 and thus this remains closed. Simultaneously, a timer circuit built into IC.2 23 is activated, whereby a blocking of the serial input of IC.2 23 will be performed.

The reset circuit 27 makes sure that IC.2 23 and IC.1 22 always start with their outputs at a level, which does not activate the following circuits. The voltage monitor 28 stabilizes the supply voltage for the remainder of the circuits, and at the same times functions as a security circuit, which protects against voltage manipulation, and thus protects the electronics against damage and failure, while it in extreme instances will disconnect the power supply line.

Figure 7:
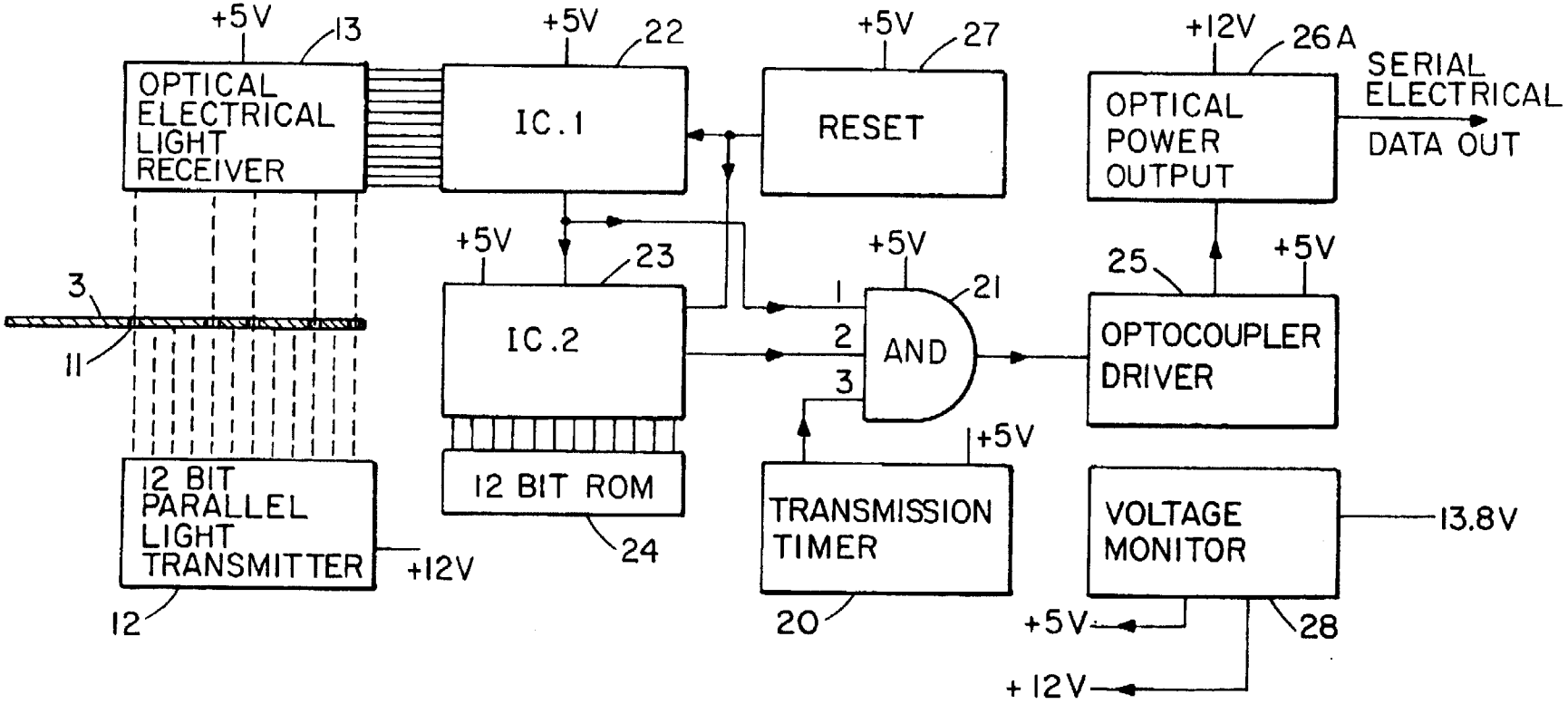
FIG. 7 shows a block diagram of the electronics with the serial electrical output utilized in the electromechanical lock and code generator.

FIG. 7 shows another block diagram of the electrical circuit B for the electromechanical lock and code generator, with a serial electrical output. Features in FIG. 7 which are similar to the features in FIG. 6 are designated by the same reference numerals. Please refer to the items in FIGS. 2, 3, and 4.

At the instant when the code medium, item 3, is inserted into the lock core, item 2 in FIGS. 3 and 4, and the said code medium 3 is turned clockwise away from the locked position, the supply voltage is connected to the electronics built into the electromechanical lock and code generator B, and the following cycle of operations is carried out:

When the lock core 2 is turned, and current is supplied to the electronic circuit B, the timer circuit 20 is activated, and an activation signal is sent to input 3 of the AND circuit 21 this activation signal only being present until the timing cycle of the timer circuit 20 has been run through, after which the AND circuit 21 again will be blocked, until the current supply has been disconnected.

The twelve light transmitters, item 12, shown here will transmit light through the light channel 10 of the lock shell 1 to and through the light channel 9 of the lock core 2 (assuming that the lock core, item 2 in FIGS. 2 and 3, is turned to its proper position, i.e. that it is turned a number of degrees in the clockwise direction), and further towards the light apertures, item 11, of the code medium. If the code medium, item 3 in FIGS. 2 and 3, presents a light aperture, item 11, the light will continue through the light apertures, item 11, of the code medium 3, through the opposite light channel, item 9*a* in FIG. 3, of the lock core 2, then through the opposite light channel, item 10*a* in FIG. 3, of the lock shell 1, in order to finally be received by the photocells, item 13, of the receiver (the photocells may be photo diodes or photo transistors). In the electrical circuit, the light received by the photocells 13 will be converted from optical signals to electrical signals, which now contain an electrical code based on the combination of holes, item 11, in the code medium 3. The code thus produced will then be passed to the parallel inputs of the integrated circuit (IC.1) 22. In IC.1 22, the signal is converted to a serial electrical signal. This signal is then sent to two locations: firstly, to the input 1 of a three-input integrated AND circuit 21 and secondly to the serial input of another integrated circuit (IC.2) 23. In the latter circuit, the two codes, which have been received successively at the serial input, will be compared to the code sent from the ROM circuit 24 to the parallel inputs of IC.2 23 and if there is conformity between these, an activation signal is sent from the output of IC.2 23 to input 2 of the AND circuit 21. The AND circuit 21 is thus opened, assuming that the activation signal from the timer circuit 20 is still present at input 3 of the AND circuit 21 and thus the serial signal on input 1 is allowed to pass through the AND circuit 21 and to an optocoupled driver circuit 25 continuing through to the power output 26A of the code transmitter, where the said power output 26A then sends out the code on an electrical code transportation medium at a predetermined transmission rate, and within a short time interval predetermined by the timer circuit 20. In the case of nonconformity between the received code at the serial input of IC.2 23 and the code delivered from the ROM circuit 24 to the parallel inputs of IC.2 23, no activation signal will be sent to the input 2 of the AND circuit 21 and thus this remains closed. Simultaneously, a timer circuit built into IC.2 23 is activated, whereby a blocking of the serial input of IC.2 23 will be performed.

The reset circuit 27 makes sure that IC.2 23 and IC.1 22 always start with their outputs at a level that does not activate the following circuits. The voltage monitor 28 stabilizes the supply voltage for the remainder of the circuits, and at the same times functions as a security circuit, which protects against voltage manipulation, and thus protects the electronics against damage and failure, while it in extreme instances will disconnect the power supply line.

Figure 8:
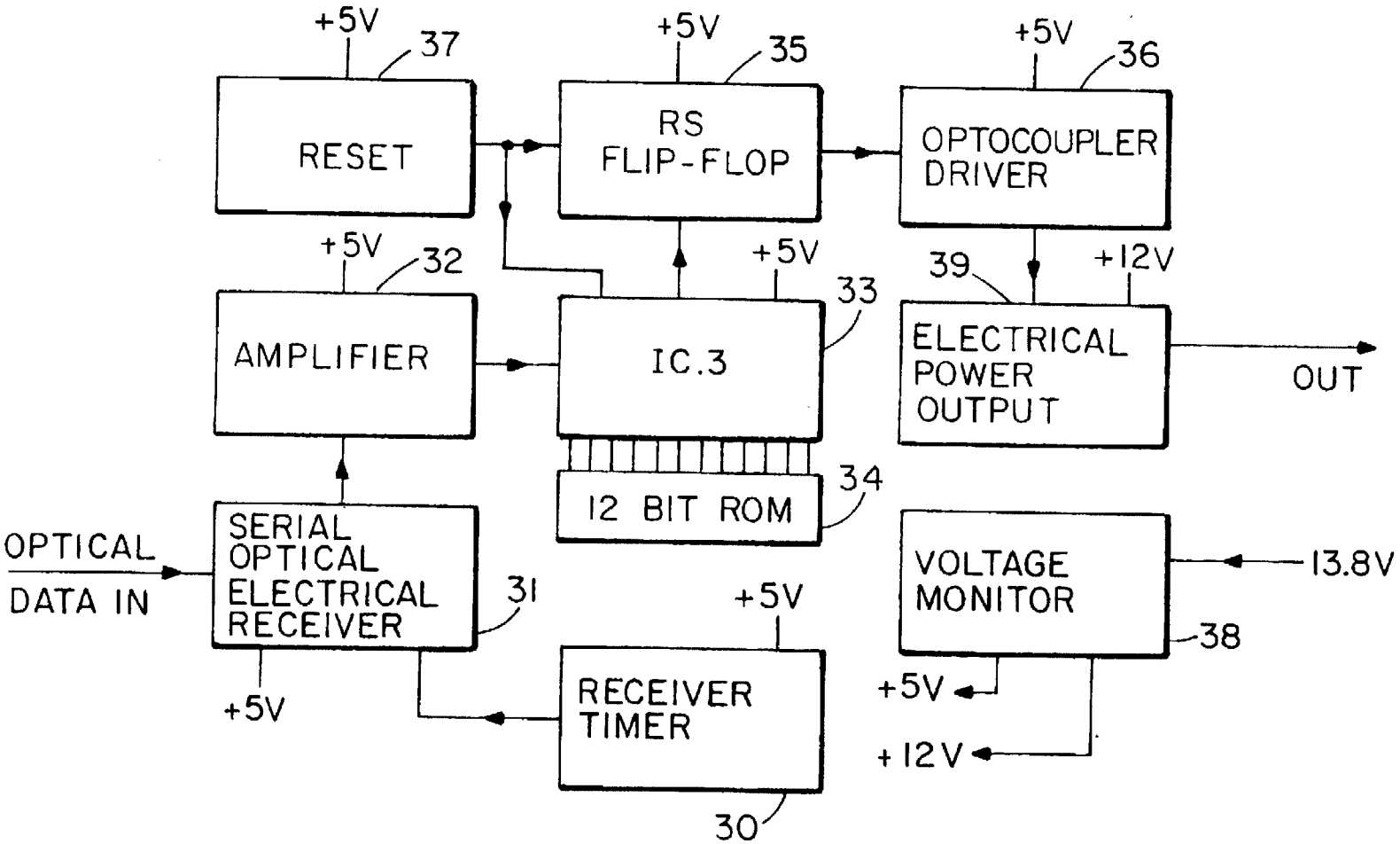
FIG. 8 shows a block diagram of the electronics with the serial optical input utilized in the electronic code lock.

FIG. 8 shows a block diagram of the electrical circuit E in the electronic code lock with a serial optical input. When current is supplied to the electronic circuit, the timer circuit 30 is activated, and an activation signal is sent to the input circuit 31, this circuit will then open the optical input, which now will be active until the timer circuit 30 has carried out its timing cycle. The input will then remain closed until the current supply has been disconnected.

When the serial code arrives at the receiver 31 of the electronic code lock, a conversion from an optical to a serial electrical signal is firstly performed, after which the signal proceeds to a serial electrical amplifier 32 ensuring that the signal is amplified to a 5 volt digital signal level. Following amplification, the signal will be lead to the serial input of an integrated circuit (IC.3) 33 where the decisive analysis of the code contained in the signal takes place. The first prerequisite for processing is that the code is presented at the correct transmission rate. If the transmission rate is correct, two successive codes will be analyzed by comparing them to a code permanently stored in the ROM circuit (read only memory) 34. If both codes are correct, then IC.3 33 will by way of its output activate the RS Flip-Flop circuit 35. This circuit 35 will then activate the optocoupler driver 36, which in turn activates the power output 39.

In the case of nonconformity between the code received at the serial input of IC.3 33 and the code stored in the ROM circuit 34 a timed blocking of the serial input of IC.3 33 will be activated, and only after the blocking time has expired will the serial input of IC.3 33 be reopened.

The electronic code lock is in addition, provided with a reset circuit 37, which at startup ensures that IC.3 33 is readied for reception of codes from the input, and that the RS Flip-Flop circuit 35 is placed in the 'inactivated state'.

The voltage monitor 38 stabilizes the supply voltage for the remainder of the circuits, and at the same times functions as a security circuit, which protects against voltage manipulation, and thus protects the electronics against damage and failure, while it in extreme instances will disconnect the power supply line.

Figure 9:
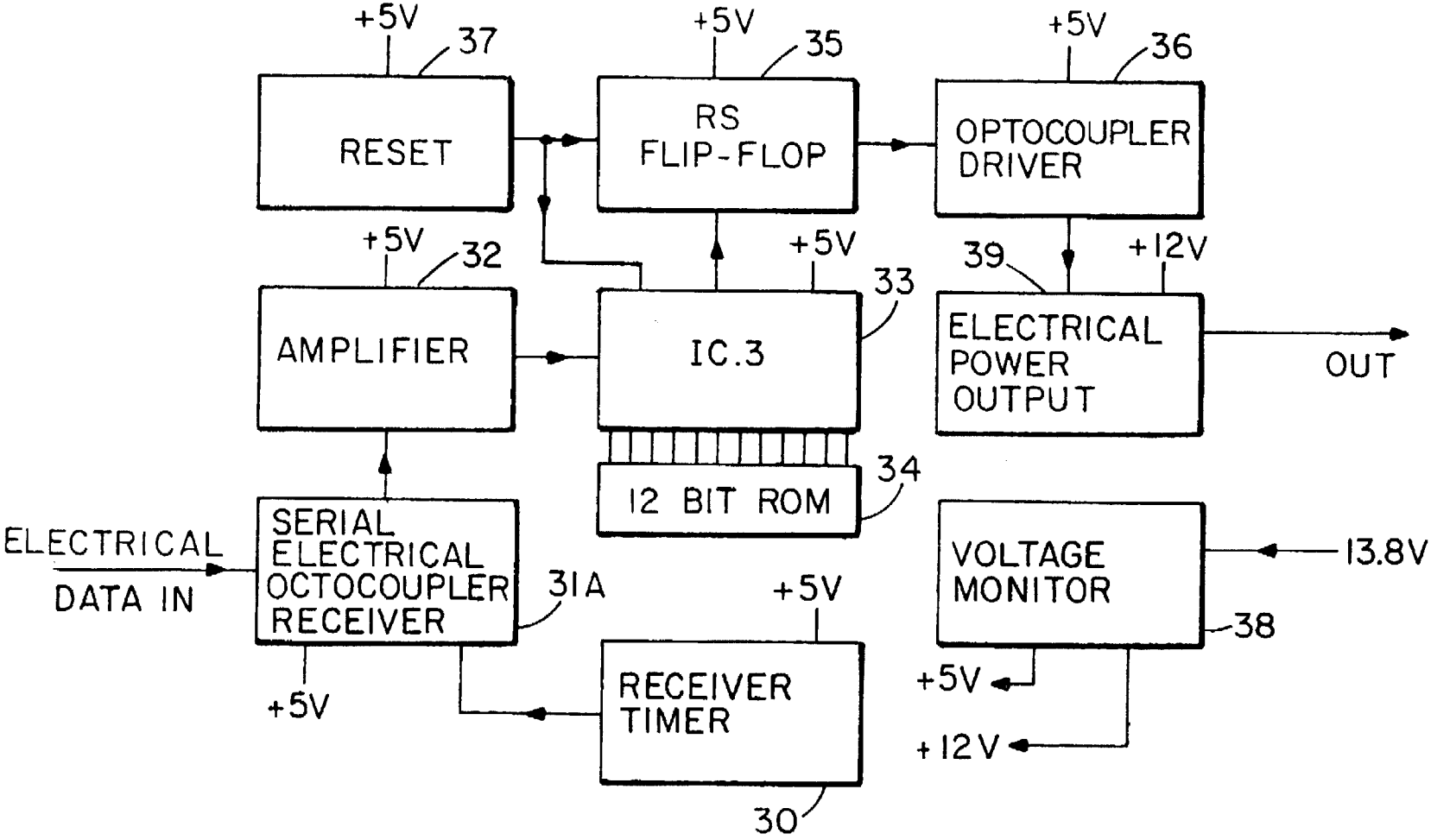
FIG. 9 shows a block diagram of the electronics with the serial electrical input utilized in the electronic code lock.

FIG. 9 shows another block diagram of the electrical circuit E in the electronic code lock with a serial electrical input. Features in FIG. 9 which are similar to the features in FIG. 8 are referenced by the same reference designators. When current is supplied to the electronic circuit E, the timer circuit 30 is activated, and an activation signal is sent to the input circuit 31A, this circuit will then open the electrical input, which now will be active until the timer circuit 30 has carried out its timing cycle. The input will then remain closed until the current supply has been disconnected.

When the serial code arrives at the receiver 31A of the electronic code lock, the signal will firstly pass through an optocoupling circuit, after which the signal proceeds to a serial electrical amplifier 32 ensuring that the signal is amplified to a 5 volt digital signal level. Following amplification the signal will be lead to the serial input of IC.3 33 where the decisive analysis of the code contained in the signal takes place. The first prerequisite for processing is, that the code is presented at the correct transmission rate. If the transmission rate is correct, two successive codes will be analyzed by comparing them to a code permanently stored in the ROM circuit (read only memory) 34. If both codes are correct, then IC.3 33 will by way of its output activate the RS Flip-Flop circuit 35. This circuit 35 will then activate the optocoupler driver 36, which in turn activates the power output in 39.

In the case of nonconformity between the code received by the serial input of IC.3 33 and the code stored in the ROM circuit 34 a timed blocking of the serial input of IC.3 33 will be activated, and only after the blocking time has expired will the serial input of IC.3 33 be reopened.

The electronic code lock is, in addition, provided with a reset circuit 37, which at startup ensures that IC.3 33 is readied for reception of codes from the input, and that the RS Flip-Flop circuit 35 is placed in the 'inactivated state'.

The voltage monitor 38 stabilizes the supply voltage for the remainder of the circuits, and at the same times functions as a security circuit, which protects against voltage manipulation, and thus protects the electronics against damage and failure, while it in extreme instances will disconnect the power supply line.

We claim:

1. An electronic lock system comprising:

a key including a key shaft, wherein said key shaft has a specific mechanical profile which is symmetrical with respect to a longitudinal axis of said key shaft and has light passages substantially located on said longitudinal axis and arranged in a specific code;

a key-operated lock cylinder arranged at an operation site and including a lock shell, a key-receiving lock core, and locking pins, wherein said locking pins are adapted to be arranged in said lock shell and said lock core in a configuration matching said specific mechanical profile of said key shaft when said key shaft is inserted into said key-receiving lock core, wherein said lock core is provided with at least one pair of light signal transmitting channels;

a code reading arrangement associated with said lock cylinder for reading said specific code and outputting a detection signal corresponding to said specific code, wherein said code reading arrangement includes at least one light emitter located in said lock shell on a first side of said lock core and includes at least one corresponding light receiver located in said lock shell on a second side of said lock core;

a programmed code circuit which receives said detection signal from said code reading arrangement and generates an actuator energizing signal in response to said detection signal; and a lock actuator device which is provided at a locking site remote from said operation site and which receives said actuator energizing signal, wherein said programmed code circuit comprises a code generating circuit which is incorporated in said lock cylinder and an electronic code lock circuit which is provided at said locking site;

wherein said code generating circuit comprises:

a first memory which stores a first reference code corresponding to said specific code;

first comparing means for comparing said detection signal with said first reference code and outputting a corresponding electronic code lock circuit activation signal; and transmission means for transmitting said electronic code lock circuit activation signal to said electronic code lock circuit, wherein said electronic code lock circuit comprises:

a second memory which stores a second reference code;

second comparing means for inputting said electronic code lock circuit activation signal from said transmission means, for comparing said electronic code lock circuit activation signal with said second reference code, and for generating said actuator energizing signal based on said electronic code lock circuit activation signal and said second reference code.

2. An electronic lock system according to claim 1, wherein said first reference code equals said second reference code.

3. An electronic lock system according to claim 1, wherein said transmission means comprises a cable.

4. An electronic lock system as claimed in claim 1, wherein each of said light signal transmitting channels of said lock core has a shape of a sector of a circle when considered in a plane perpendicular to a longitudinal axis of said lock core, wherein an apex of said sector coincides with said longitudinal axis of said lock core, wherein said light signal transmitting channels are respectively provided on said first side and said second side of said lock core, wherein said at least one light emitter and said at least one receiver are located so as to be within an angular range of movement of said light signal transmitting channels, respectively, and wherein light signals are transmitted from said at least one light emitter to said at least one light receiver via said light signal transmitting channels.

5. An electronic lock system according to claim 1, wherein at least one of said first memory and said second memory is a read only memory.

6. An electronic lock system according to claim 1, wherein said electronic code lock circuit activation signal is a serial electrical signal.

7. An electronic lock system according to claim 1, wherein said electronic code lock circuit activation signal is a serial optical signal.

8. An electronic lock system according to claim 1, wherein said second comparing means comprises:

a receiver circuit which receives said electronic code lock circuit activation signal from said transmission means;

a receiver timer connected to said receiver circuit;

an amplifier circuit for amplifying said electronic code lock circuit activation signal to produce an amplified signal;

a first integrated circuit which inputs said amplified signal, converts said second reference code from said second memory from a parallel format to a serial reference code, compares said amplified signal and said serial reference code, and outputs a comparison signal when said amplified signal equals said serial reference code; and an output circuit which outputs said actuator energizing signal based on said comparison signal.

9. An electronic lock system according to claim 8, wherein said output circuit comprises:

a flip-flop circuit which inputs said comparison signal and outputs a resultant signal based on said comparison signal; and a driver circuit which inputs said resultant signal and outputs said actuator energizing signal.

10. An electronic lock system according to claim 1, wherein said transmission means transmits said electronic code lock circuit activation signal at a predetermined rate, and wherein said second comparing means determines if said electronic code lock circuit activation signal is input at said predetermined transmission rate and compares said electronic code lock circuit activation signal with said second reference code only when said electronic code lock circuit activation signal is input at said predetermined transmission rate.

11. An electronic lock system according to claim 10, wherein said first reference code equals said second reference code.

12. An electronic lock system according to claim 10, wherein said second comparing means comprises:

a receiver circuit which receives said electronic code lock circuit activation signal from said transmission means;

a receiver timer connected to said receiver circuit;

an amplifier circuit for amplifying said electronic code lock circuit activation signal to produce an amplified signal;

a first integrated circuit which inputs said amplified signal, converts said second reference code from said second memory from a parallel format to a serial reference code, compares said amplified signal and said serial reference code, and outputs a comparison signal when said amplified signal equals said serial reference code; and an output circuit which outputs said actuator energizing signal based on said comparison signal.

13. An electronic lock system according to claim 12, wherein said output circuit comprises:

a flip-flop circuit which inputs said comparison signal and outputs a resultant signal based on said comparison signal; and a driver circuit which inputs said resultant signal and outputs said actuator energizing signal.

14. An electronic lock system according to claim 1, wherein said first comparing means comprises:

a first integrated circuit which converts said detection signal output from said at least one light receiver from a parallel format into a serial detection signal;

a second integrated circuit which converts said first reference code output from said first memory from a parallel format to a first serial reference code and which compares said serial detection signal and said first serial reference code to produce a corresponding first comparison signal;

a logic gate which inputs said serial detection signal, said first comparison signal, and a time control signal from a transmission timer, performs a logic operation on said serial detection signal, said first comparison signal, and said time control signal, and outputs a resultant signal; and a driver circuit which inputs said resultant signal and outputs said electronic code lock circuit activation signal to said transmission means.

15. An electronic lock system according to claim 14, wherein said second integrated circuit is adapted to compare said serial detection signal with said first serial reference code and a second successive serial detection signal with said first serial reference code to produce said first comparison signal.

16. An electronic lock system according to claim 14, wherein said electronic code lock circuit activation signal is a serial electrical signal.

17. An electronic lock system according to claim 14, wherein said electronic code lock circuit activation signal is a serial optical signal, and wherein said driver circuit comprises an optical converter for converting said resultant signal into said serial optical signal.

18. An electronic lock system as claimed in claim 14, wherein each of said light signal transmitting channels of said lock core has a shape of a sector of a circle when considered in a plane perpendicular to a longitudinal axis of said lock core, wherein an apex of said sector coincides with said longitudinal axis of said lock core, wherein said light signal transmitting channels are respectively provided on said first side and said second side of said lock core, wherein said at least one light emitter and said at least one light receiver are located so as to be within an angular range of movement of said light signal transmitting channels, respectively, and wherein light signals are transmitted from said at least one light emitter to said at least one light receiver via said light signal transmitting channels.

19. An electronic lock system according to claim 14, wherein said second comparing means comprises:

a receiver circuit which receives said electronic code lock circuit activation signal from said transmission means;

a receiver timer connected to said receiver circuit;

an amplifier circuit for amplifying said electronic code lock circuit activation signal to produce an amplified signal;

a third integrated circuit which inputs said amplified signal, converts said second reference code from said second memory from a parallel format to a second serial reference code, compares said amplified signal and said second serial reference code, and outputs a second comparison signal when said amplified signal equals said second serial reference code; and an output circuit which outputs said actuator energizing signal based on said second comparison signal.

20. An electronic lock system as claimed in claim 19, wherein each of said light signal transmitting channels of said lock core has a shape of a sector of a circle when considered in a plane perpendicular to a longitudinal axis of said lock core, wherein an apex of said sector coincides with said longitudinal axis of said lock core, wherein said light signal transmitting channels are respectively provided on said first side and said second side of said lock core, wherein said at least one light emitter and said at least one light receiver are located so as to be within an angular range of movement of said light signal transmitting channels, respectively, and wherein light signals are transmitted from said at least one light emitter to said at least one light receiver via said light signal transmitting channels.

21. An electronic lock system according to claim 19, wherein said output circuit comprises:

a flip-flop circuit which inputs said second comparison signal and outputs a second resultant signal based on said second comparison signal; and a driver circuit which inputs said second resultant signal and outputs said actuator energizing signal.

22. An electronic lock system according to claim 21, wherein said electronic code lock circuit activation signal is a serial electrical signal.

23. An electronic lock system according to claim 21, wherein said electronic code lock circuit activation signal is a serial optical signal, and wherein said driver circuit comprises an optical converter for converting said resultant signal into said serial optical signal.

24. An electronic lock system according to claim 21, wherein said transmission means transmits said electronic code lock circuit activation signal at a predetermined rate, and wherein said second comparing means determines if said electronic code lock circuit activation signal is input at said predetermined transmission rate and compares said electronic code lock circuit activation signal with said second reference code only when said electronic code lock circuit activation signal is input at said predetermined transmission rate.

25. An electronic lock system according to claim 24, wherein said first reference code equals said second reference code.

* * * * *